US010099840B2

(12) United States Patent
Frost et al.

(10) Patent No.: US 10,099,840 B2
(45) Date of Patent: Oct. 16, 2018

(54) CUP MADE OF A PAPER MATERIAL

(75) Inventors: Robert Frost, Landshut (DE); Uwe Messerschmid, Albershausen (DE); Werner Stahlecker, Goeppingen (DE)

(73) Assignee: PTM PACKAGING TOOLS MACHINERY PTE. LTD., Singapore (SG)

( * ) Notice: Subject to any disclaimer, the term of this patent is extended or adjusted under 35 U.S.C. 154(b) by 822 days.

(21) Appl. No.: 13/438,173

(22) Filed: Apr. 3, 2012

(65) Prior Publication Data

US 2012/0190519 A1 Jul. 26, 2012

Related U.S. Application Data

(62) Division of application No. 11/879,218, filed on Jul. 16, 2007, now Pat. No. 8,172,127.

(Continued)

(30) Foreign Application Priority Data

Jul. 17, 2006 (DE) ..... 10 2006 034 267
May 14, 2007 (DE) ..... 10 2007 024 243

(51) Int. Cl.
*B31B 1/00* (2006.01)
*B31B 7/00* (2006.01)

(Continued)

(52) U.S. Cl.
CPC ..... *B65D 81/3869* (2013.01); *B65D 3/14* (2013.01); *B65D 3/30* (2013.01); *B65D 21/0233* (2013.01);

(Continued)

(58) Field of Classification Search
CPC .. B65D 81/3869; B65D 21/0233; B65D 3/06; B65D 1/265; B65D 3/12; B65D 3/22; B65D 1/26

(Continued)

(56) References Cited

U.S. PATENT DOCUMENTS 2,103,831 A * 12/1937 Sidon ..... 229/5.6
2,114,470 A * 4/1938 Hutt et al. ..... 229/400

(Continued)

FOREIGN PATENT DOCUMENTS

CH 563 889 7/1975
CN 2 618 515 Y 6/2004

(Continued)

OTHER PUBLICATIONS

Notification of Transmittal of International Search Report dated Sep. 26, 2007 (2 pages) for PCT/EP2007/006095.

(Continued)

*Primary Examiner* — Andrew M Tecco
*Assistant Examiner* — Eyamindae Jallow
(74) *Attorney, Agent, or Firm* — Flynn Thiel, P.C.

(57) ABSTRACT

A cup made of a paper material having a fillable interior, which cup is formed by a conical sleeve and a bottom. The bottom is attached to the sleeve at the lower end of the interior with a bottom skirt in an essentially liquid-tight way. The sleeve and/or the bottom in the area of the bottom skirt and/or the bottom skirt itself comprises, at least in one area along the periphery, an outwardly projecting widening. A lower edge of the widening forms a standing surface for the cup. The widening can serve to hold another cup of the same type, and can act together with a similar cup during stacking. The cup can include a heat insulating outer sleeve.

25 Claims, 8 Drawing Sheets

Related U.S. Application Data

(60) Provisional application No. 60/860,413, filed on Nov. 21, 2006.

(51) Int. Cl.

| | |
|---|---|
| ***B31B 49/02*** | (2006.01) |
| ***B65D 81/38*** | (2006.01) |
| ***B65D 3/14*** | (2006.01) |
| ***B65D 3/30*** | (2006.01) |
| ***B65D 21/02*** | (2006.01) |
| ***B65D 25/36*** | (2006.01) |
| *B31B 50/60* | (2017.01) |
| *B31B 105/00* | (2017.01) |
| *B31B 50/59* | (2017.01) |

(52) U.S. Cl.
CPC ..... *B65D 25/36* (2013.01); *B31B 50/594* (2018.05); *B31B 50/60* (2017.08); *B31B 2105/0022* (2017.08)

(58) Field of Classification Search
USPC ..... 493/100, 152, 153, 155, 157, 158
See application file for complete search history.

(56) References Cited

U.S. PATENT DOCUMENTS

| | | | | |
|---|---|---|---|---|
| 2,285,341 | A | 6/1942 | Lyon | |
| 2,425,786 | A * | 8/1947 | Conti | 493/128 |
| 2,426,159 | A * | 8/1947 | Barbierl | 493/56 |
| 2,563,352 | A | 8/1951 | Morse | |
| 2,816,697 | A | 12/1957 | Amberg | |
| 3,049,277 | A | 8/1962 | Shappell | |
| 3,262,626 | A * | 7/1966 | Davis | 229/400 |
| 3,325,048 | A | 6/1967 | Edwards | |
| 3,372,830 | A * | 3/1968 | Edwards | 206/519 |
| 3,437,253 | A | 4/1969 | Davis et al. | |
| 3,499,569 | A * | 3/1970 | Wentzel | 215/374 |
| 3,526,316 | A | 9/1970 | Kalogris | |
| 3,529,743 | A | 9/1970 | Ehrbar et al. | |
| 3,568,878 | A | 3/1971 | Fotos | |
| 3,854,583 | A | 12/1974 | Amberg et al. | |
| 3,935,946 | A * | 2/1976 | Bengert | 206/516 |
| 3,970,492 | A | 7/1976 | Amberg et al. | |
| 3,995,740 | A | 12/1976 | Amberg et al. | |
| 4,049,122 | A | 9/1977 | Maxwell | |
| 4,053,346 | A | 10/1977 | Amberg et al. | |
| 4,088,526 | A | 5/1978 | Amberg et al. | |
| 4,106,397 | A | 8/1978 | Amberg et al. | |
| 4,197,948 | A | 4/1980 | Amberg et al. | |
| 4,836,400 | A * | 6/1989 | Chaffey et al. | 220/612 |
| 5,685,480 | A | 11/1997 | Choi | |
| 5,725,916 | A * | 3/1998 | Ishii et al. | 428/34.2 |
| 6,024,244 | A | 2/2000 | Hicks | |
| 6,109,518 | A | 8/2000 | Mueller et al. | |
| 6,308,883 | B1 * | 10/2001 | Schmelzer et al. | 229/403 |
| 6,662,996 | B2 * | 12/2003 | Hartjes | 229/400 |
| 6,663,927 | B2 * | 12/2003 | Breining et al. | 428/34.2 |
| 6,703,090 | B2 * | 3/2004 | Breining et al. | 428/34.2 |
| 7,100,770 | B2 | 9/2006 | D'Amato | |
| 7,195,805 | B2 * | 3/2007 | Breining et al. | 428/34.2 |
| 7,481,356 | B2 | 1/2009 | Stahlecker | |
| 7,905,821 | B2 | 3/2011 | Stahlecker | |
| 2006/0118608 | A1 | 6/2006 | Stahlecker | |
| 2006/0186012 | A1 * | 8/2006 | D'Amato | 206/505 |
| 2006/0226210 | A1 | 10/2006 | Stahlecker | |
| 2008/0006643 | A1 * | 1/2008 | Ma | 220/592.16 |
| 2009/0159653 | A1 | 6/2009 | Stahlecker | |
| 2012/0165170 | A1 * | 6/2012 | Wischusen, III | 493/100 |

FOREIGN PATENT DOCUMENTS

| | | |
|---|---|---|
| DE | 961 053 | 3/1957 |
| DE | 1 904 088 | 9/1969 |
| DE | 31 15 689 A1 | 1/1982 |
| DE | 297 06 961 U1 | 9/1998 |
| DE | 10 2004 056 932 A1 | 5/2006 |
| DE | 10 2005 017 741 | 10/2006 |
| EP | 1 227 042 B1 | 7/2002 |
| GB | 191206984 | 1/1913 |
| GB | 558 436 | 1/1944 |
| GB | 832 407 | 4/1960 |
| GB | 2 420 267 A | 5/2006 |
| JP | 55-134046 | 10/1980 |
| JP | 08217051 A | 8/1996 |
| JP | 2001 192015 | 7/2001 |
| JP | 2003 340943 | 2/2003 |
| JP | 2003 128038 A | 5/2003 |
| JP | 2004 099079 | 4/2004 |

OTHER PUBLICATIONS

International Search Report of PCT/EP2007/006095 (7 pages).
Written Opinion of International Searching Authority (7 pages) for PCT/EP2007/006095.
Notification of Transmittal of International Search Report dated Sep. 25, 2007 (2 pages) for PCT/EP2007/006094.
International Search Report of PCT/EP2007/006094 (5 pages).
Written Opinion of International Searching Authority (8 pages) for PCT/EP2007/006094.
German Patent Office Search Report dated Mar. 22, 2007 (4 pages).
Office Action of State Intellectual Property Office, P.R. China dated Jul. 24, 2009 (3 pages).
Second Office Action from China Patent Office dated Sep. 30, 2010 with English translation (9 pages).
German Patent Office Examination Report issued in German Application No. 10 2007 024 243.5 dated Jul. 31, 2012 (6 pages).
Office Action issued in German Appln. No. 10 2007 024 243.5 dated Oct. 10, 2016 (7 pages).

* cited by examiner

CUP MADE OF A PAPER MATERIAL

CROSS REFERENCE TO RELATED APPLICATION

This is a divisional of prior U.S. application Ser. No. 11/879,218, filed Jul. 16, 2007, now U.S. Pat. No. 8,172,127 which claims the benefit of U.S. Provisional Application No. 60/860,413, filed Nov. 21, 2006, the disclosure of which is hereby incorporated by reference in its entirety.

FIELD OF THE INVENTION

The present invention relates to a cup made of a paper material and having a fillable interior, which interior is formed by a conical sleeve and a bottom, whereby the bottom is attached at the lower end of the interior by means of a bottom skirt to the sleeve in an essentially liquid-tight way.

The present invention relates further to a process for producing a cup made of paper material, which consists of a conical sleeve and a bottom attached in the area of the lesser circumference of the sleeve by means of a bottom skirt.

BACKGROUND AND SUMMARY OF THE INVENTION

A cup of this kind is prior art in Japanese published patent application JP2001-192015A. The bottom skirt of the known cup widens out downwards. The widening serves to fix an outer sleeve, which surrounds the interior defining sleeve by forming a hollow space. As the widening of the bottom skirt defines the distance between the inner sleeve and the outer sleeve, the widening of the bottom skirt along the periphery must be continuous. A partial widening of the bottom skirt is not possible. The outer sleeve is placed around the bottom skirt, folded inwards and attached thereto. When the outer sleeve is being attached to the bottom skirt, it may occur that the liquid tightness of the bottom skirt is affected. The attaching of the outer sleeve by means of folding is very complicated.

In the case of the known cup, the outer sleeve surrounds the bottom skirt completely, so that this can no longer be seen from the outside. When the outer sleeve is folded inwards and attached from the inside to the bottom skirt, counter-holding from the outside is no longer possible. The outer sleeve can only be pressed against from the inside with a very low level of force, which the bottom skirt can take up itself. If the pressure force is too great, the bottom skirt may tear; on the other hand, the attaching of the outer sleeve can be inadequate if the pressure force is too low. In the case of attaching the outer sleeve by means of heat sealing it can occur that the sealing between the bottom skirt and the sleeve defining the interior dissolves, as when the inwardly folded outer sleeve is being sealed, no counter pressure can be exerted from the outside on the bottom skirt.

In the case of cups made of paper material, the bottom skirt is a very important element of the cup. The bottom skirt is necessary for the connection between the sleeve and the bottom. At least two material layers are disposed in thickness direction on top of one another, namely the material of the bottom and the material of the interior-defining sleeve. The bottom is advantageously pot-shaped, whose open side faces away from the filling opening of the cup. The at least two material layers are advantageously arranged along the wall of the pot-shaped bottom. It can be additionally provided that for example the sleeve is folded inwards around the material of the bottom, and that the bottom skirt consists of three or more material layers. The material of the bottom is glued or sealed to the material of the sleeve in the area of the bottom skirt, in order that it is liquid-tight for at least a certain time.

The term "paper material", from which the bottom and the sleeve are made, includes various material, which comprise at least one layer of paper, paperboard or cardboard. In addition the material can comprise one or more layers made of synthetics and/or aluminium. It can also be provided that the paper material is waxed or coated, in order to provide a resistance against the liquid with which the cup is subsequently filled. The paper material is advantageously coated at least on the side facing the interior with a thin synthetic layer, preferably made of polyethylene. In contrast to purely synthetic material, the formability and in particular the ductibility of such paper material is limited. In the case of too great a deformation, the paper material itself, or a provided coating, may tear, so that the liquid-tight properties are impaired. The bottom skirt is therefore an essential design feature in the case of cups made of paper material and cannot be omitted.

It is an object of the present invention to simplify the producibility of a cup of the above mentioned type and to avoid difficulties with liquid-tightness at the bottom skirt.

This object has been achieved in accordance with the present invention in that the sleeve and/or the bottom in the area of the bottom skirt and/or the bottom skirt itself comprises at least in an area along the periphery an outwardly projecting widening, and in that a lower edge forms a standing surface for the cup.

The object has been achieved in accordance with the process according to the present invention in that a semi-finished product being essentially liquid-tight and comprising a fillable interior is used, in which the sleeve and/or the bottom in the area of the bottom skirt and/or the bottom skirt itself is widened outwards in at least an area along the periphery.

The standing surface of the cup is enlarged by means of the widening, even if the widening is only partial, so that the cup acquires an improved stability. The widening is hereby not covered, or not completely covered, by an outer sleeve, so that the material of the sleeve or the bottom directly forms the standing surface. The bottom skirt thus cannot be impaired in its thickness by the application of additional material of the outer sleeve. In an advantageous embodiment, the widening is continuous and formed uniformly along the periphery. When the paper material is coated, it is advantageous to form the widening only to the point where the coating does not tear.

As a semi-finished product is used, in which the bottom and the sleeve are attached liquid-tight together in the area of the bottom skirt, the widening can be formed at the bottom skirt without impairing the liquid-tightness of the bottom skirt. It can be advantageous to use a semi-finished product in which the bottom skirt, as seen in axial section, extends essentially parallel to the middle axis of the cup, in which in the case of a round cup cross section, the bottom skirt extends essentially cylindrically. It can also be provided that the widening takes place only partially in an area along the periphery. In the case of a bottom skirt which no longer tapers, or of a partial widening, the paper material requires less elongation and the danger of tear formation is reduced. The stability of the cup can nevertheless be increased by means of an enlarged standing surface.

In an advantageous embodiment of the present invention, the bottom skirt is not widened in its entire height. The area of the bottom skirt bordering the bottom remains in its original form, while the lower edge of the bottom skirt is widened. The height of the widening at the bottom skirt can hereby correspond to approximately half the height of the bottom skirt. The bottom skirt then comprises, as seen in axial cross section, varying angles of inclination to the middle axis of the cup, whereby the bottom skirt in the area of the lower edge widens out at an enlarged angle of inclination. The bottom skirt comprises two different height areas which fulfil different functions. The upper height area serves to seal the fillable interior and attaches the conical sleeve essentially liquid-tight to the bottom. In the lower height area of the bottom skirt, the material of the sleeve defining the interior and/or the wall of the bottom is widened and forms with its lower edge an enlarged standing surface for the cup. In this height area a liquid-tight connection between the material of the bottom and the material of the sleeve is no longer absolutely necessary.

It can be advantageous that the material of the sleeve or of the bottom in the area of the bottom skirt, at least in the area of the lower edge, is warmed up before and/or during the widening process. Warming up can for example take place by means of blowing the bottom skirt with hot air or by means of a heated widening tool. The temperature is advantageously so chosen that a synthetic layer present on the paper material does not reach its melting point, but rather only becomes somewhat softer.

It is advantageous when the widening tool comprises at least two elements, of which one widens the bottom skirt from the inside, while the second acts as a counter tool and counters from the outside. This ensures that even in the case of a warmed-up bottom skirt, the liquid-tight connection between sleeve and bottom does not dissolve. Both elements of the widening tool can consist for example of radially movable jaws, axially movable mandrels or of rollers running along the periphery of the bottom skirt.

The cup according to the present invention is very versatile, as it can be applied without an outer sleeve, or with a variety of different outer sleeves. A heat-insulating sleeve is advantageously provided, which surrounds the interior-defining sleeve while forming a hollow space. The outer sleeve is hereby advantageously slid onto the conical interior-defining sleeve along the middle axis and fixed, before the bottom skirt is widened.

The widening on the bottom skirt can be applied very advantageously in order to improve the stacking properties of the cup. A stackable cup is for example known in European patent EP 1 227 042 B1. The interior-defining sleeve of the known cup comprises a first means for holding another cup of the same type. The known cup comprises a second holding means on an outer sleeve, which surrounds the interior-defining sleeve with a heat-insulating hollow space. The second holding means is formed by a curled part rolled inwards and applied to the lower end of the outer sleeve. When the cups are stacked, the second holding means applied to the outer sleeve can act together with a first holding means applied to a similar cup. A number of cups stacked on top of one another form hereby a stable stack, in which the stacked cups rest securely on top of one another, without however wedging in each other. As wedging of the stacked cups is prevented, the individual cups can therefore be very easily removed from the stack.

The known cup has the disadvantage in that the forces occurring in stacking are relayed through the interior-defining sleeve and through the outer sleeve. The forces, which must be relayed within the cup from the first holding means to the second holding means, are first transferred through the interior-defining sleeve to connecting points between the inner sleeve and the outer sleeve and relayed via these connecting points to the outer sleeve. In the outer sleeve the forces are relayed to the second holding means formed as an inwardly rolled edge and there transferred to the next cup. The inner sleeve and the outer sleeve must be sufficiently stable in order to take up the occurring forces. In addition, the connecting points between the outer sleeve and the inner sleeve must be designed to take up the maximum occurring forces.

The scope of the design of the cup according to European patent EP 1 227 042 B1 is disadvantageously limited, as the second holding means applied to the outer sleeve must always be adapted to the dimensions of the first holding means of another cup of the same type, and also to the relayed forces. It is not possible to provide the outer sleeve with an optional form, or to alter its form as required. It is also not possible to omit the outer sleeve in case of need without losing the good stacking properties.

In the cup according to the present invention it is provided that a means for holding another cup of the same type is arranged on the bottom skirt, which means can act together with a similar cup when the cup is stacked. The holding means is advantageously formed by the widening. It is advantageously provided that a first holding means is arranged on the interior-defining sleeve, which first holding means can act together with a second holding means applied on the widening of a similar cup when the cup is stacked.

The stackable cup is advantageously produced in a process by means of the following procedural steps:

- forming of at least one first means for holding another cup of the same type on the interior-defining sleeve;
- forming of a second means for holding on the bottom skirt, which second holding means can act together with a first holding means applied to a similar cup when the cup is stacked.

The second holding means is hereby arranged on the interior-defining sleeve or on the bottom, or on a bottom skirt connecting the interior-defining sleeve with the bottom. In any case, the second holding means is applied to a component of the cup which is in contact with the fillable interior.

The formation of the first and second holding means in a cup in the form of a prefabricated semi-finished product has the advantage in that the production of a semi-finished product can take place on a standard cup-making machine, downstream of which a device for forming the holding means is arranged.

The cup according to the present invention has the advantage in that, even without an outer sleeve, the cup can be reliably stacked in a stable manner without wedging and easily de-stacked again. If it is provided that the cup should be assigned a heat-insulating outer sleeve, this can be achieved to a great extent independently and free of the limitations of the cup in European patent EP 1 227 042 B1. The forces occurring during stacking are simply relayed within the interior-defining components from the first holding means to the second holding means. An outer sleeve is thus not absolutely necessary. If, however, an outer sleeve is to be provided, it is not loaded by the forces occurring during stacking. The bottom skirt, by means of which the interior-defining sleeve is connected to the bottom, is a very stable part of the cup and is very well suited to taking up the forces. The forces occurring during stacking are relayed essentially by the interior-defining sleeve from the first holding means to the second holding means, which second holding means can be formed by the widening of the bottom skirt. This permits the formation of a very stable stack comprising a large number of cups, which do not become wedged inside one another even when the stack is subjected to knocks or is for example placed abruptly on the ground. The bottom and the interior-defining sleeve are in any case strong enough to take up the forces occurring during stacking, as they also must take up the forces occurring during filling.

In order to prevent a number of cups wedging during stacking it is advantageous that the dimensions of the second holding means are adapted to the dimensions of the first means for holding another cup of the same type. The first means for holding another cup of the same type can hereby be optionally formed. It is, however, essential that a contour is formed which can take up forces acting in the axial direction of the cup, that is, the forces which act between two cups during stacking. The first holding means is advantageously designed as a bead or a rib, which is at least formed in one area along the circumference of the interior-defining sleeve. The bead or rib can be designed continuously along the circumference or with interruptions.

If, in an embodiment of the present invention, it is provided that the cup comprises a heat-insulating outer sleeve, the design of the heat-insulating outer sleeve is hereby optional. The outer sleeve can for example be made of synthetic, paper or composite material. In order to improve the insulation effect, the outer sleeve can also be corrugated, fluted, embossed or comprise a foam layer. The outer sleeve can be designed as a multi-layered sleeve, for example a corrugated intermediary layer can be provided, which is then covered over by a smooth outer layer. As the cup according to the present invention can be stacked independently of the type of outer sleeve, one and the same inner cup can be combined in a simple and almost endless variety of ways with a variety of outer sleeves. Without changing the shape and dimensions of the inner cup or the components forming the fillable interior, a variety of cups having various optical and haptical designs can be created, owing to the fact that the appearance of the cup as seen by the consumer is mainly defined by the design of the outer sleeve.

In a process for manufacturing a double-walled cup, the following procedural steps are advantageously executed:

- forming of at least one first means for holding another cup of the same type on the sleeve defining the interior;
- sliding on of an outer sleeve over the interior-defining conical sleeve;
- fixing the outer sleeve to the interior-defining sleeve
- forming of a second holding means at the bottom skirt, which second holding means can act together with a first holding means applied to a similar cup when the cup is stacked.

The fixing of the outer sleeve on the inner sleeve can take place for example by means of sealing or gluing. This effects a secure connection between the outer sleeve and the interior-defining sleeve, so that the outer sleeve is reliably prevented from slipping, even if the outer sleeve has only a low height.

In order to achieve a good appearance of the cup, it is advantageous that the outer sleeve ends below the first means for holding another cup of the same type, or even below the bottom. The first holding means applied to the inner sleeve is thus covered over by the outer sleeve and is no longer visible from the outside. Furthermore, it is advantageous when the outer sleeve ends above the widening of the bottom skirt. The widening of the bottom skirt can thus be achieved by means of the action of tools, one arranged outside and one arranged inside of the bottom skirt, without the outer sleeve, which is already slid onto the interior-defining sleeve, hindering the forming of the widening. The widening can, as a result, be very exactly formed. In order that space remains below the outer sleeve for placing the tool there, a distance of more than one millimeter, in particular of more than 2 mm, is provided between the outer sleeve and the widening.

The widening is advantageously spread outwards to such a degree that a parallel to the interior-defining sleeve disposed on the lower edge of the widening, extends at a certain distance outside of the interior-defining-sleeve. In order that a provided outer sleeve does not prevent the stacking of the cups, it is advantageous that the outer contours of the outer sleeve are located within the parallel to the interior-defining sleeve, which parallel is disposed on the widening of the bottom skirt.

BRIEF DESCRIPTION OF THE DRAWINGS

These and further objects, features and advantages of the present invention will become more readily apparent from the claims and the following detailed description thereof when taken in conjunction with the accompanying drawings. Individual features of the various embodiments shown and described can be combined optionally without exceeding the framework of the present invention.

DETAILED DESCRIPTION

Figure 1:
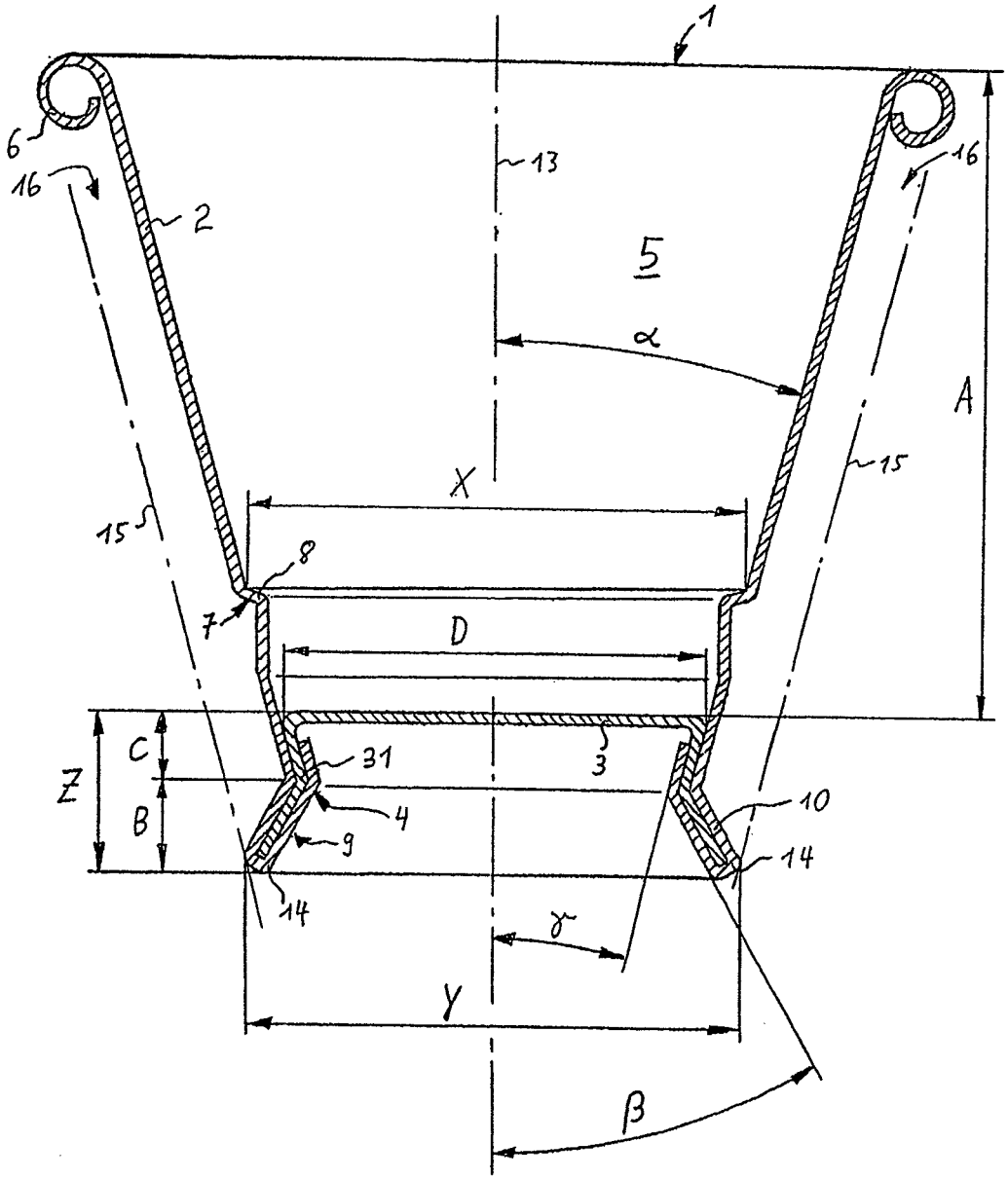
FIG. 1 shows a cup in longitudinal section according to the present invention.

The cup 1 shown in FIG. 1 consists essentially of a conical sleeve 2 and a pot-shaped bottom 3. The open side of the pot-shaped bottom 3 is arranged in such a way that it is facing away from the filling opening of the cup 1. The bottom 3 is attached liquid-tight with its wall 31 to the sleeve 2 in the area of its smallest diameter by means of a bottom skirt 4. In the area of the bottom skirt 4, the material of the sleeve 2 is placed around the wall 31 of the bottom 3 and folded inwards. The sleeve 2 and the bottom 3 form a fillable interior 5 of the cup 1. The fillable interior 5 has a height A. The sleeve 2 defining the interior 5 comprises on its top edge, that is, in the area of its largest circumference, an outwardly rolled lip 6, which surrounds the filling opening.

The conical feature of the sleeve 2 is hereby to be understood in that the sleeve 2 tapers in longitudinal section as shown in FIG. 1 from the lip 6 to the bottom 3. The sleeve 2 comprises hereby in the area of the fillable interior 5 an angle of inclination $\alpha$ to the middle axis 13 of the cup 1. The form of the sleeve 2 in cross section is hereby irrelevant. The sleeve 2 may be circular, oval or even rectangular with rounded edges in cross section. In the case of a round cross section of the conical sleeve 2, the cup 1 has a truncated cone shape, while in the case of a rectangular cross section, the conical sleeve 3 has a truncated pyramid shape.

The bottom skirt 4 comprises at least in the area along its periphery an outwardly projecting widening 10. A lower edge 14 of the widening 10 at the bottom skirt 4 forms a standing surface for the cup 1. The cup 1 stands on its standing surface during use, which standing surface is enlarged by the widening 10. This makes it difficult for the cup 1 to tip over. The widening 10 is advantageously designed continuously around the periphery of the bottom skirt 4.

Figure 2:
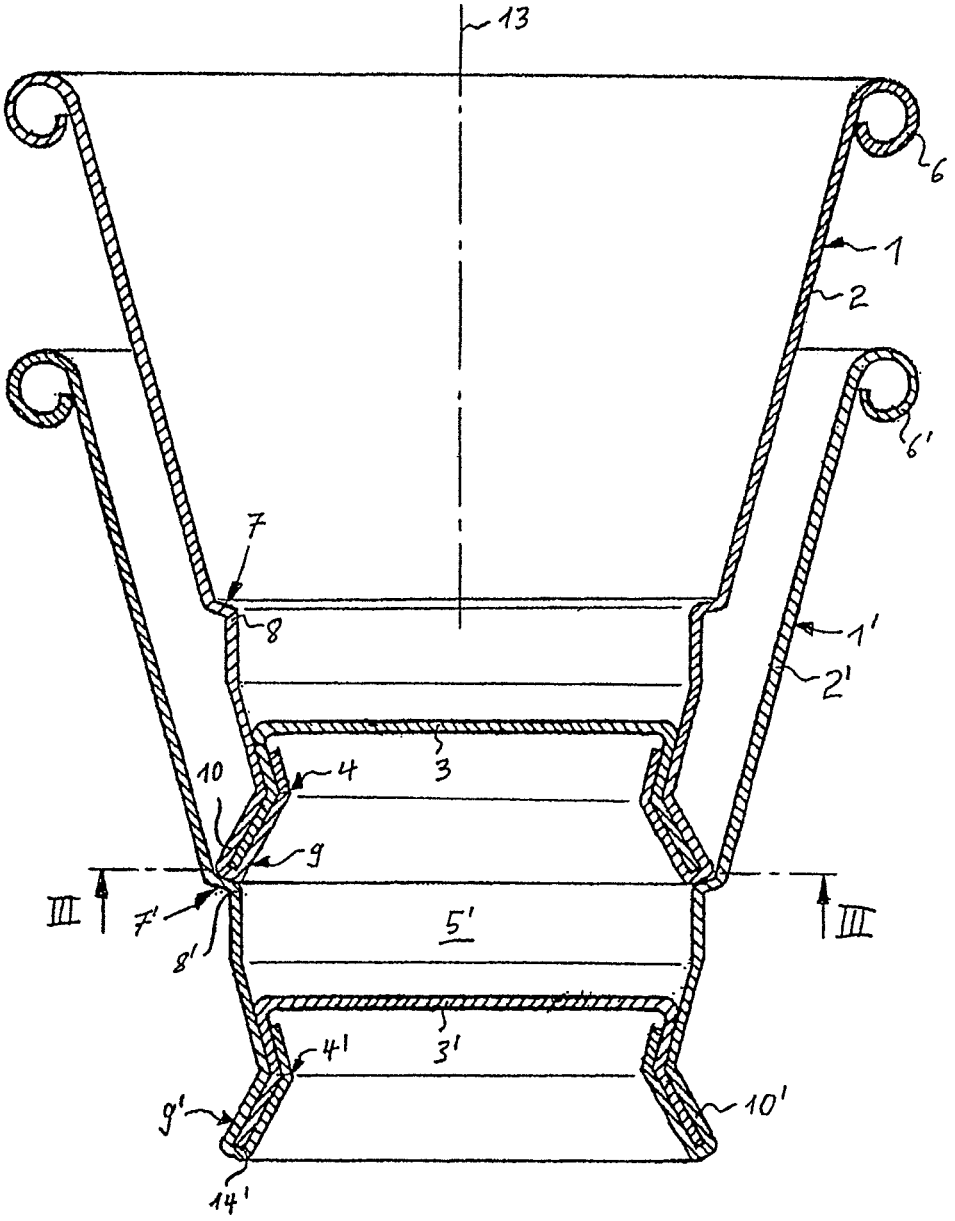
FIG. 2 shows a view similar to FIG. 1 of two stacked cups.

The outwardly projecting widening 10 also forms means 9 for holding another cup 1' of the same type, which means can act together with a similar cup 1' when the cup is stacked. The stacking of the cup 1 in a similar cup 1' is shown in FIG. 2. The widening 10, as a means 9 for stacking the cup 1, can hereby for example act together with a sleeve 2' defining the interior 5'. Further stacking means are not absolutely necessary.

The sleeve 2 defining the interior 5 advantageously comprises a first means 7 for holding another cup 1 of the same type, which means can be optionally formed. It is important that the first holding means 7 comprises a contour which can take up forces acting in the direction of the middle axis 13 of the cup 1, that is, forces which act between two cups during stacking. The first holding means 7 can be formed for example by means of a rib or a bead 8, which projects into the interior of the cup 1. The above mentioned second means 9 in the form of a widening 10 is arranged at the bottom skirt 4, at which the sleeve 2 defining the interior 5 is folded around the pot-shaped, deep drawn bottom 3 and fixed liquid-tight thereto.

The dimension Y of the second holding means 9 is adapted to the dimension X of the first means 7 for holding another cup 1' of the same type. In the case of a circular cross section of the cup 1, the dimension X of the first holding means 7 corresponds to the inner diameter of the sleeve 2 above the bead 8. The dimension Y of the second holding means 9 corresponds to the largest outer diameter of the widening 10 at the bottom skirt 4, that is, the diameter which the widening 10 encloses. The adaptation of the dimensions X and Y take place in that the dimension Y is somewhat smaller or at maximum is the same size as the dimension X.

The acting of the first means 7 and the second means 9 for holding is evident in the cups 1 and 1' shown in FIG. 2. The first means 7' of the cup 1' applied to the sleeve 2' defining the interior 5' takes up the second means 9 of the cup 1. The widening 10 applied to the bottom skirt 4 of the cup 1, and in particular the bottom end of the widening 10 is supported hereby on the bead 8', which is formed into the sleeve 2'. Because of the above mentioned adaptation of the dimension X of the first holding means 7 to the dimension Y of the second holding means 9, it is ensured that the widening 10 of the cup 1 stands on the bead 8' in a secure and stable way, without however wedging itself in the conical sleeve 2'. The forces which occur along the middle axis 13 during stacking, for example the forces of weight of the cup 1 or of the cups stacked on top of it, are taken up reliably by the bead 8' as the holding means 7' and relayed via the sleeve 2' to the lower edge 14' of the bottom skirt 4' of the lower cup 1', and passed on to the ground from the lower edge 14' located at the standing surface. This ensures the easy removability of the cup 1 or 1' when the cups are de-stacked, even when very high forces in the direction of the middle axis 13 occur.

In order not to impair the liquid tightness of the bottom skirt 4 when forming the widening 10, it is advantageous when the height B of the widening 10—as seen in FIG. 1—is smaller than the overall height Z of the bottom skirt 4. As a result of the low height B of the widening 10, a height area C remains on the bottom skirt 4, which provides the sealing between the sleeve 2 defining the interior 5 and the bottom 3. The height B corresponds preferably hereby to approximately half the height Z. The bottom skirt 4, as seen in axial section of FIG. 1, comprises different angles of inclination $\beta$ and $\gamma$ to the middle axis 13 of the cup 1. The angle of inclination $\beta$ of the height area B of the bottom skirt 4 is hereby in any case so inclined that the bottom skirt 4 widens out towards the lower edge 14 and has the largest dimension Y at its lower edge 14, that is as seen parallel to the middle axis 13 the lower edge 14 of the bottom skirt 4 forms the area distanced furthest from the middle axis 13. In the case shown, the bottom skirt 4 still tapers in the height area C with the angle of inclination $\gamma$, which corresponds to the angle of inclination $\alpha$ of the sleeve 2 in the area of the interior 5. The widening 10 continues in any case up to the lower edge 14, which forms the standing surface. Further possible embodiments of the bottom skirt 4 are described below with the aid of FIG. 9.

The diameter Y surrounding the widening 10 is hereby advantageously larger than the diameter D, which surrounds the area of the bottom 3, which is in contact with the interior 5. In order to permit effective stacking, and that the stacking height is not unnecessarily high, it is advantageous when the holding means 7 assigned to the sleeve 2 defining the interior 5 is not arranged higher above the bottom 3 than a third of the height A of the interior 5. Even if the means 7 is omitted, and the widening 10 is supported directly on the conical area of the sleeve 2, the diameter Y enclosing the widening 10 is advantageously smaller than a diameter enclosing the inner contour of the sleeve 2 at a height above the bottom 3 of approximately a third of the height A.

A height area C, in which a part of the bottom skirt 4 remains in its original form without a widening, is in particular important for the process for producing a stackable cup 1 according to the present invention, in which process a semi-finished product having an already fillable interior 5 is used, which semi-finished product comprises a conical sleeve 2 and a bottom 3 already attached in a liquid-tight manner thereto. The semi-finished product comprises a bottom skirt 4, which does not yet comprise a widening 10. The bead 8 is formed as the first holding means 7 and the widening 10 as the second holding means 9 on the semi-finished product. This process has the advantage in that the semi-finished product can be produced on a standard cup-making machine. The semi-finished product is fed to an arrangement downstream of the standard cup-making machine, which arrangement forms the first holding means 7 and the second holding means 9 on the semi-finished product and completes the production of the stackable cup 1. The liquid tightness of the bottom skirt 4 is not impaired because of the height area C remaining unformed.

The rib or the bead 8 can be stamped or rolled by forming tools, which are placed to the sleeve 2 in axial or radial direction of the cup 1. The widening 10 at the bottom skirt 4 can for example be formed by a cone-shaped mandrel, which is placed to the bottom skirt 4 from below. If required, the bottom skirt 4 can be heated for the purposes of forming the widening 10. Because forming tools, which execute a sliding motion in relation to the surface of the bottom skirt 4, can very easily form creases, it can therefore also be advantageous to form the widening 10 by means of a rolling tool or by means of a tool which spreads out in radial direction. It can hereby be advantageous to assign to the outer circumference of the bottom skirt 4 a correspondingly formed counter tool, in order to support the formation of the widening 10.

Figure 3:
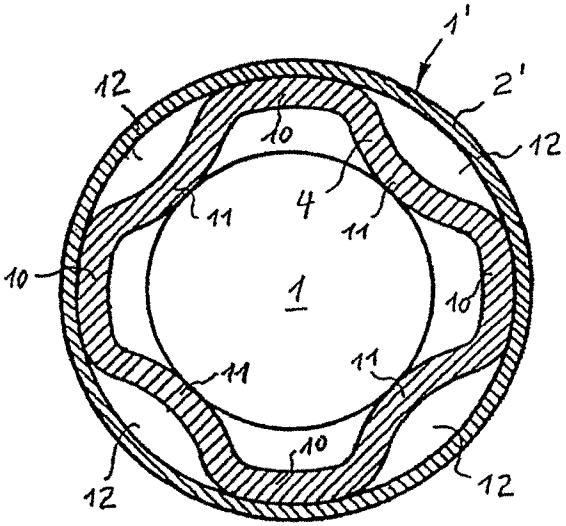
FIG. 3 shows a view along the intersectional surface III-III of FIG. 2 of a bottom skirt provided with a number of widenings.

FIG. 3 shows a particular embodiment of the widening 10 at the bottom skirt 4. The widening 10 according to FIG. 3 does not extend around the entire circumference of the bottom skirt 4. Instead, four widenings 10 are evenly distributed on the circumference, between each of said widenings 10 an area 11 without a widening is provided, which area 11 corresponds to the original contour of the bottom skirt 4. When the cup 1 is stacked in a similar cup 1', air passages 12, in conjunction with a bead 8 circulating the entire circumference, form between the sleeve 2' and the bead 8' of the cup 1' and the non-widened areas 11 of the cup 1, which could facilitate the de-stacking of the cups. When the cup 1 is removed from the cup 1', the air passages 12 permit air from the atmosphere to flow into the area of the interior 5' of the cup 1', located below the bottom 3 of the cup 1, so that a vacuum, which would act against the withdrawal motion of the cup 1, cannot form.

Figure 8:
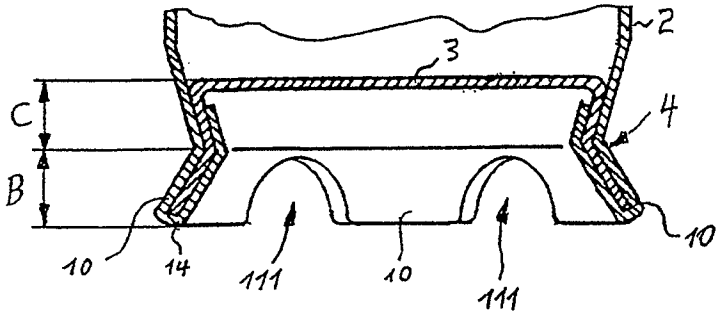
FIG. 8 shows a longitudinal section similar to FIG. 1 of a bottom skirt comprising a plurality of partial widenings and recesses located therebetween.

In a further embodiment of the partial widening 10 of FIG. 3, the concave embodiment of the area 11 between the four widenings 10 can also be designed as linear or slightly convex. The outline of the bottom skirt 4 can be polygon in form, whereby the corners are, of course, rounded. Furthermore, as denoted in FIG. 8, it can be provided that the bottom skirt 4 comprises recesses 111, slits or predetermined breaking points in the areas 11 according to FIG. 3. In particular when the widening 10 is to project relatively far out, it can happen that the paper material of the sleeve 2 tears in an uncontrolled way at the lower edge 14. In order to prevent this uncontrolled tearing, recesses 111 or slits can be stamped into the paper material in the areas 11 between the widenings 10, as shown in FIG. 8, which recesses 111 or slits extend over the height area B of the bottom skirt 4, which height area B is not necessary for the tightness of the bottom skirt 4. Depending on the ductibility of the material at the bottom skirt 4, the height of the recesses 111 can be different, but do not however extend to any great degree above the height area B, so that a sufficiently large height area C remains for the purposes of sealing. The recesses 111 can either be provided in the blank of the sleeve 2, before the semi-finished product of sleeve 2 and bottom 3 is produced, or the recesses 111 can be just as well applied to the completed bottom skirt 4 before widening occurs.

Although not shown in FIGS. 1 to 3, it can be advantageous to assign the cup 1 a heat-insulating outer sleeve according to any of the FIGS. 4 to 7, which surrounds the sleeve 2 defining the interior 5 while forming a hollow space. In order that the stacking of the cup 1 is not impaired, it can be advantageous that the outer contour of the outer sleeve is located within a parallel 15 to the sleeve 2 defining the interior 5, whereby the parallel 15 is disposed on the widening 10 of the bottom skirt 4. As long as an outer sleeve is located within the space 16 between the parallel 15 and the sleeve 2 defining the interior 5, the stacking properties of the cup are not influenced in any way. The design possibilities are thus endless. It is also possible to equip a common embodiment of the cup 1 with variously designed outer sleeves, without having to change the first holding means 7 and the second holding means 9. Several possible embodiments for heat-insulating outer sleeves of this type are described below with the aid of FIGS. 4 to 7.

The cups 1 shown in FIGS. 4 to 7 each comprises a heat-insulating outer sleeve 417, 517, 617 and 717, which surrounds the sleeve 2 defining the interior 5 partly under formation of a hollow space 18. Cups of this type are defined as double-walled insulating cups, in which the sleeve 2, in conjunction with the bottom 3, located inside of the outer sleeve 417, 517, 617 and 717 can be defined as an "inner cup". The first means 7 for holding another cup 1' of the same type and the second holding means 9 are designed analogue to the embodiment described in FIG. 1, so that a repeat description is hereby omitted.

In the production of a double-walled cup 1 according to FIGS. 4 to 7, a first holding means 7 is formed on an inner cup fed in the form of a semi-finished product, which can already comprise a lip 6. The outer sleeve 417, 517, 617 and 717 is subsequently slid on and fixed to the sleeve 2 defining the interior 5. In a last procedural step, the second holding means 9 is formed. This has the advantage in that the second holding means 9 does not impair the sliding on of the outer sleeve 416, 517, 617, 717, and that for example the dimension Y of the widening 10 can be larger than the inner contour of the outer sleeve 417, 517, 617, 717.

Figure 4:
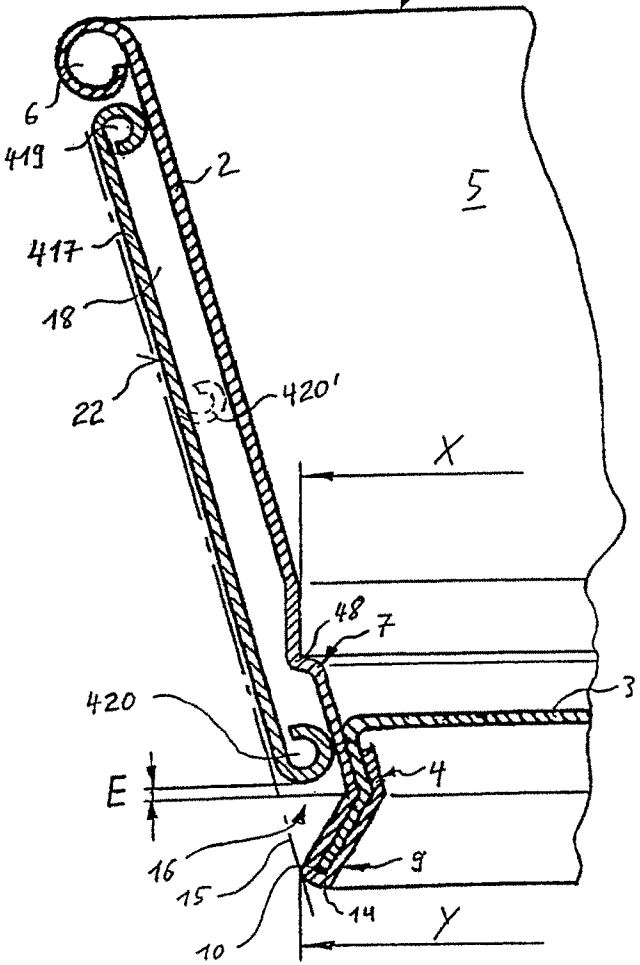
FIGS. 4 to 7 show views similar to FIG. 1 of partly shown cups in various embodiments, in which different outer sleeves are provided.

The outer sleeve 417 of the cup 1 shown in FIG. 4 is arranged essentially parallel to the sleeve 2 defining the interior 5. The outer sleeve 417 comprises on an upper and on a lower end inwardly rolled curled parts 419 and 420 and is supported by the curled parts 419 and 420 on the sleeve 2 defining the interior 5. It can be provided that the outer sleeve 417 is fixed in the area of the curled part 419 and/or 420, for example by means of gluing. The height of the outer sleeve 417 can vary as required, as shown by the curled part 420' denoted by a broken line. Particularly advantageous is a height of the outer sleeve 417, which corresponds to the shown curled part 420, whereby the outer sleeve 417 ends above the widening of the bottom skirt 4 and below the bottom 3. The distance E between the outer sleeve 417 and the widening 10 measures advantageously approximately 1 to 2 mm. The height of the outer sleeve 417 in this case ensures accessibility to the bottom skirt 4 from the outside even when the outer sleeve 417 is already slid on, so that the forming of the widening 10 with a tool radially placed from outside is not hindered by the outer sleeve 417. The curled part 420 is supported in the area of the bottom skirt 4 on the inner sleeve 5, as a result of which the outer sleeve 417 is very stable. At the same time the outer sleeve 417 also covers the first holding means 7, so that this is not recognizable from the outside. The bead 48 is, in contrast to FIG. 1, formed outwards. The take-up properties of the holding means 7 can hereby be increased, as the stretched paper material of the bead 48 has a higher stability than the compressed paper material of the bead 8 in FIG. 1.

Figure 5:
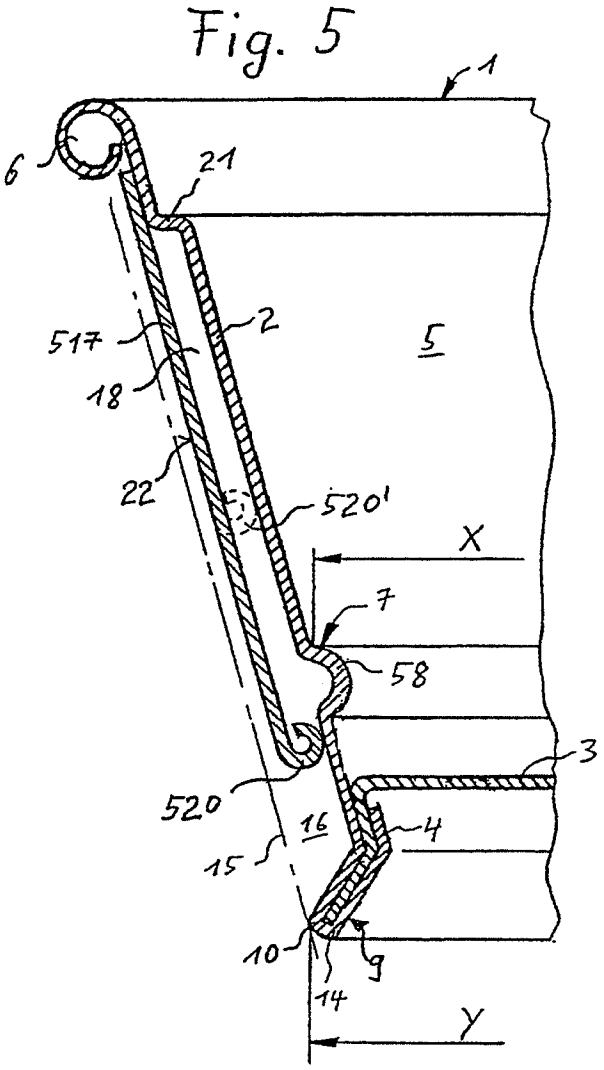

In FIG. 5, the sleeve 2 defining the interior 5 comprises an abrupt change in size in the form of a shoulder 21 in the area below the lip 6, which shoulder 21 presents itself as an abrupt increase of the cross section when seen from the bottom 3 to the lip 6. The outer sleeve 517 is attached in the area between the lip 6 and the shoulder 21 to the sleeve 2 defining the interior 5, for example by means of sealing or gluing. At its lower end the outer sleeve 517 comprises an inwardly rolled curled part 520 analogue to the curled part 420, which can, in turn lie alternatively also upwards in the position 520' as shown by the broken line. An outer sleeve 517 which ends above the bottom 3 often achieves a sufficient insulation effect and has the advantage in that the material requirements for the outer sleeve 517 are reduced. The height position of the curled part 520 can alternatively also be chosen according to the criteria as described in FIG. 4 and be disposed in a lower position. The holding means 7 is designed as a rounded rib 58, whereby the rib 58 need not be stamped out all the way around the circumference, but rather very advantageously can consist of only selected stamped areas in the sleeve 2.

Figure 5A:
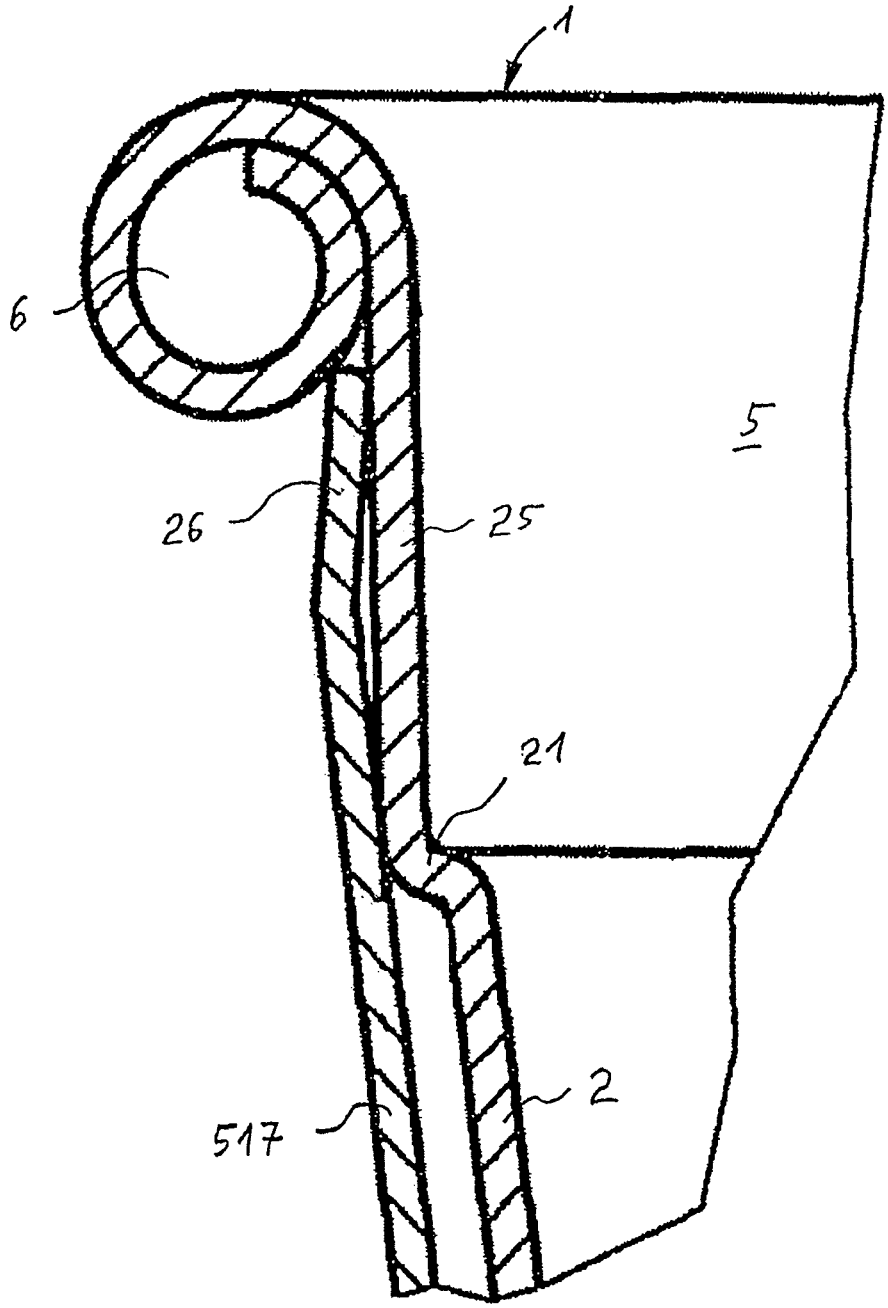

In contrast to the depiction shown in FIG. 5, the cup 1 can be designed differently in the area of the shoulder 21. An advantageous variation in the area of the shoulder 21 is shown greatly enlarged in FIG. 5A. The area of the sleeve 2 defining the interior 5, which lies between the lip 6 and the shoulder 21 and which is denoted by the reference number 25, comprises, in contrast to the depiction shown in FIG. 5, another angle of inclination to the middle axis 13 than the rest of the sleeve 2. In FIG. 5A, the area 25 of the sleeve 2 extends between lip 6 and the shoulder 21 approximately parallel to the middle axis 13. In order that the outer sleeve 517 can be placed to a small degree underneath the lip 6 when the outer sleeve 517 is slid onto the inner cup 1, the upper edge area 26 of the outer sleeve 517 is slightly compressed. The edge area 26 does not uniformly extend the conical outer sleeve 517, but rather comprises a somewhat tapering diameter. If the outer sleeve 517, as shown in FIG. 5A, is pushed slightly with its upper edge into the lip 6, the cup 1 obtains particularly good outward appearance, as the upper edge of the outer sleeve 517 is no longer visible. If the outer sleeve 517 is pushed further into the lip 6 in an embodiment not shown, the wedging of the outer sleeve 517 effects a fixing of the outer sleeve 517 by means of the material of the lip 6. For certain applications, the wedging of the outer sleeve 517 in the lip 6 can be sufficient to provide the only attachment of the outer sleeve 517.

Figure 6:
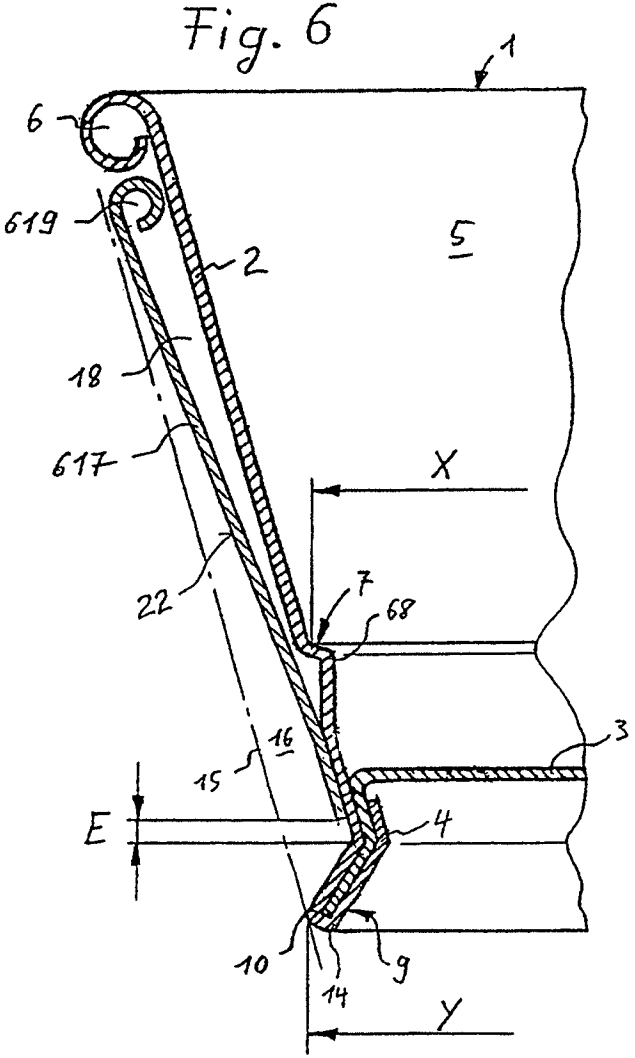
Figure 6A:
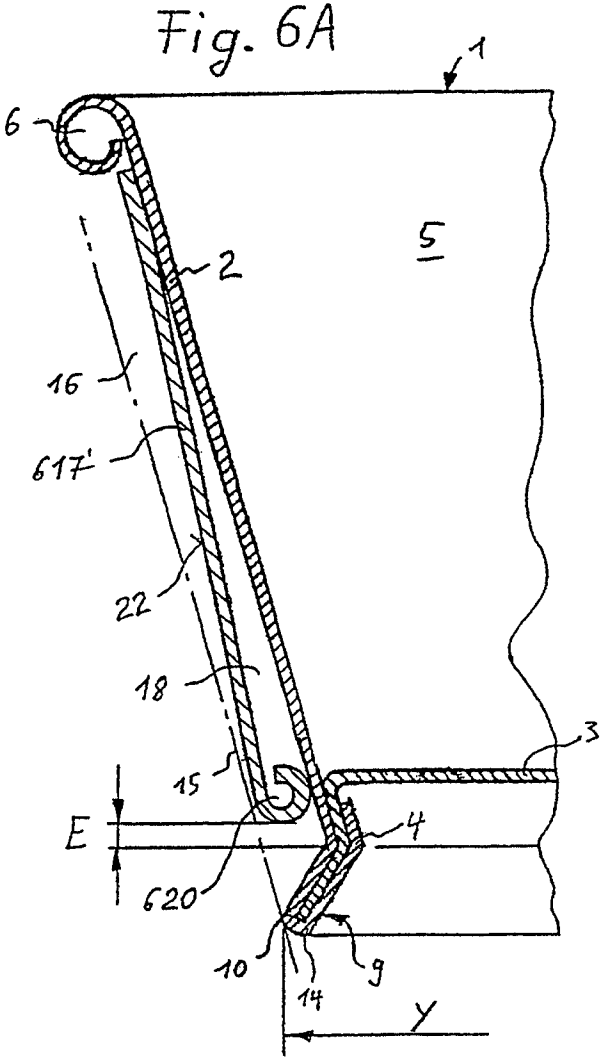

FIG. 6 shows a variation of an outer sleeve 617, in which the hollow space 18 has its greatest thickness in the upper area and tapers increasingly downwards. At the upper end of the outer sleeve 617 an inwardly rolled curled part 619 is provided, which can be supported on the sleeve 2 defining the interior 5. The outer sleeve 617 can also end above the bottom skirt 4, or as shown, above the widening 10 at a distance E and can, for example, be sealed there in this area in a flattened position. FIG. 6A shows an alternative, in which the outer sleeve 617 also does not extend parallel to the sleeve 2. The outer sleeve 617' is sealed in a flattened position below the lip 6 and the thickness of the hollow space 18 increases in size in the downward direction. The outer sleeve 617' is supported at the lower end with a curled part 620 analogue to the curled part 420 on the sleeve 2. The cup 1 in FIG. 6A does not comprise a bead 68. During stacking, the widening 10, without any further means for stacking, acts with another cup 1' of the same type and is supported directly on the sleeve 2 defining the interior 5.

Figure 7:
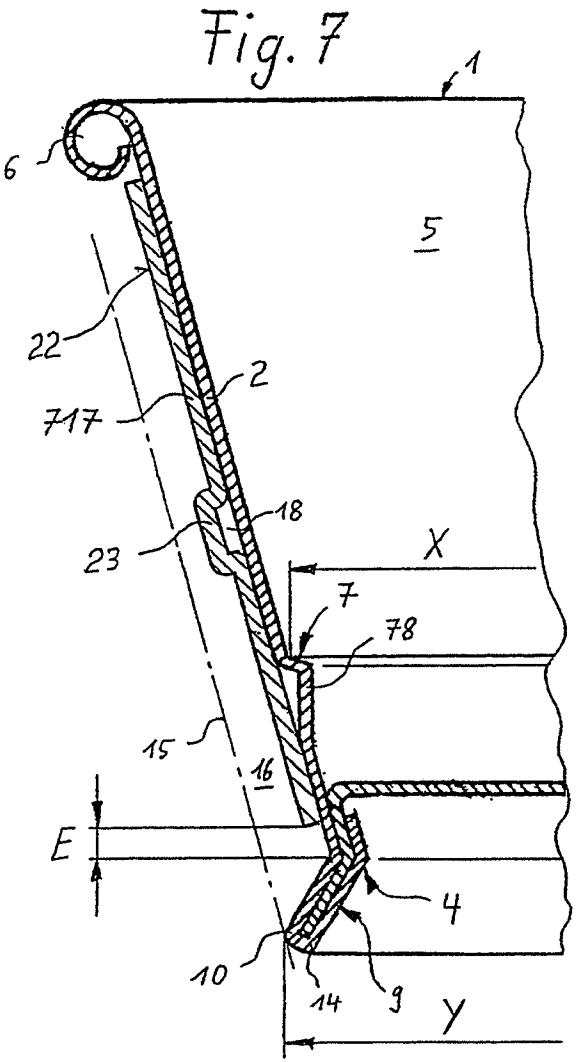

An outer sleeve 717 is shown in FIG. 7, which encloses tightly the sleeve 2 defining the interior 5 and essentially sits closely over the entire surface. An outer sleeve 717 of this type can be sufficient when the requirements of the insulation effect of the cup 1 are not particularly demanding. In addition, a closely sitting outer sleeve 717 can improve the stability of the cup 1, as the sleeve 2 is practically supported over its entire height on the outer sleeve 717. The fixing of the outer sleeve 717 takes place advantageously in turn by means of sealing or gluing, whereby the fixing can take place in selected areas or also over the entire surface. In an embodiment of the outer sleeve 717, outwardly embossed areas 23 are provided in the outer sleeve 717. The embossed areas 23 can be design elements in the cup 1, for example, writing which denotes the product contained inside. The embossed area 23 can also be used, however, in order to specifically increase the insulating effect of the outer sleeve 717 in certain areas, as beneath the embossed areas 23, hollow spaces 18 occur. The embossed areas 23 can for example be arranged in the areas of the cup 1 which come into contact with the hand holding the cup.

Even when the bead 48, 58 of the first holding means 7 in the cups shown in FIGS. 4 and 5 have a somewhat different design to the other Figures, the dimension Y of the second holding means 9 is nevertheless adapted to the dimension X of the first means 7 for holding another cup 1' of the same type. When the dimensions X and Y in the cases of the cups 1 of FIGS. 4 to 7 having the varying outer sleeves 417, 517, 617 and 717 are identical, then all these cups 1 can be stacked optionally in combination with one another without wedging, as all the outer sleeves 417, 517, 617 and 717 lie within the space 16 between the parallel 15 and the sleeve 2 defining the interior 5. In order to vary the optical and haptical appearance of the cup 1, the outer side 22 of the outer sleeve 417, 517, 617 and 717 can have varying structures.

The outer side 22 can for example be corrugated, fluted, embossed or comprise a foamed coating. It can also be provided that the outer sleeves 417, 517 and 617 have a fluted design, and also to provide additionally the outer side 22 with a smooth cover of the fluted structure in the form of a further sleeve, in order to improve the insulating properties of the cup 1.

In particular the embodiment of the outer sleeve 417 comprising an upper curled part 419 or the fixing of the outer sleeve 517 in the area of the shoulder 21 of the sleeve 2 have the advantage in that in an area closely below the lip 6, already a very wide hollow space 18 occurs between the sleeve 2 and the outer sleeve 417, 517, which provides a very high insulating effect. The curled part 419 or the shoulder 21 ensure, even without additional means, for example foam coatings or corrugated paperboard layers within the hollow space 18, that the distance between the sleeve 2 and the outer sleeve 417 or 517 does not decrease even under pressure, for example from a hand gripping the cup 1, and that the insulation effect is not lost.

It should be expressly pointed out here that the various embodiments of the outer sleeve 417, 517, 617 and 717, and other design elements means of the cup 1 such as the bead 8, 48, 58, 68, 78 or the shoulder 21 can, as required, be combined with one another, and are not limited to the variations shown here.

In FIGS. 9A-9K, in the individual depictions shown in FIGS. 9A-9H and 9J and 9K, various design possibilities of the cup 1 in the area of the bottom skirt 4 are shown in schematic form. In the variations of FIGS. 1 to 8, the bottom skirt 4 is always formed by three layers of material, namely by two material layers of the sleeve 2, which enclose, inside and outside, the wall 31 of the pot-shaped bottom 3. This embodiment is very often advantageous, but is not absolutely necessary in order to realize the present invention. The variations described in the following can be advantageous for certain specifications.

Figure 9A:
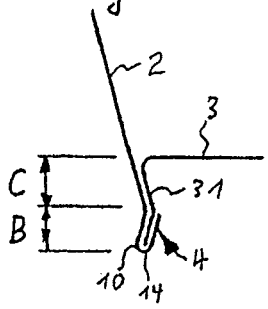
FIGS. 9A-9H and 9J and 9K show schematically and only partly longitudinal sections of various embodiments in the area of the bottom skirt of cups according to the present invention.
Figure 9B:
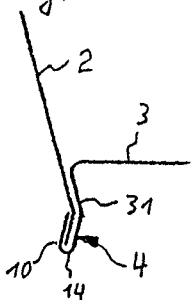

In FIG. 9A it is provided that the inwardly folded material of the sleeve 2 extends only over the height B of the widening 10. In FIG. 9B it is provided that the material of the bottom 3 is folded outwards and encloses the material of the sleeve 2. The lower edge 14 of the widening 10, which forms the standing surface for the cup 1, is formed hereby by the material of the bottom 3.

Figure 9C:
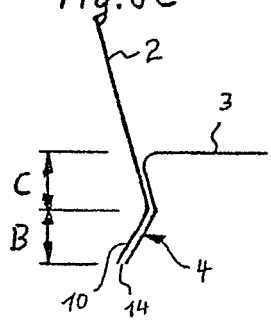
Figure 9D:
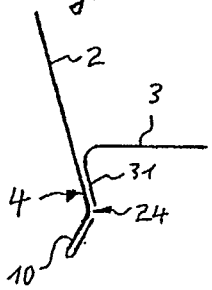
Figure 9E:
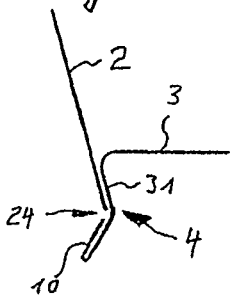

In the FIGS. 9C, 9D and 9E, embodiments are shown in which the bottom skirt 4 is formed only by two material layers. In FIG. 9C, the material of the sleeve 2 and the wall 31 of the bottom 3 both end at the lower edge 14 and form hereby the standing surface. In FIG. 9D the material of the sleeve 2 is folded inwards, without however covering over the material of the bottom 3 in the area of the wall 31. The point of contact 24 between the material of the sleeve 2 and the bottom 3 can lie at various heights, for example exactly on the border between the height areas B and C. In this case, the material of the bottom 3 is not widened when the widening 10 is formed. The widening is only applied to the double-layered material of the sleeve 2. The wall 31 of the pot-shaped bottom 3 extends only over the height area C and serves to seal the fillable interior 5. The bottom skirt 4 of FIG. 9E is designed analogously to that of FIG. 9D, however the material of the bottom 3 is folded outwards in the height area B. The material of the sleeve 2 extends only over the height area C.

Figure 9F:
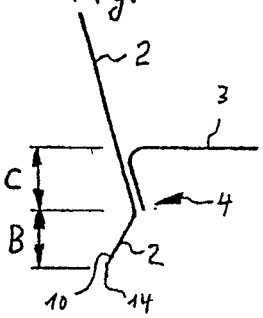
Figure 9G:
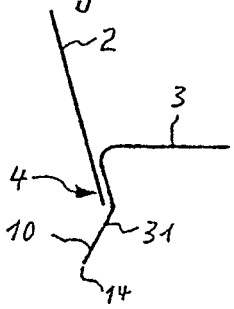

When the material of the sleeve 2 or the bottom 3 is sufficiently stable, the folded parts shown in FIGS. 9D and 9E can be completely omitted, and the widening 10, as shown in FIGS. 9F and 9G, are simply formed by one material layer. It is sufficient for the sealing of the fillable interior 5 when the materials of the bottom 3 and the sleeve 2 lie one over the other in the height area C and are attached in a liquid-tight manner.

Figure 9H:
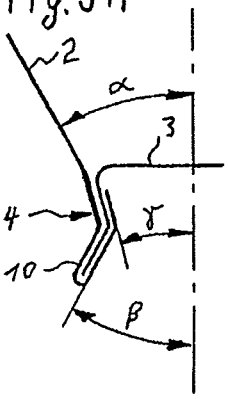
Figure 9J:
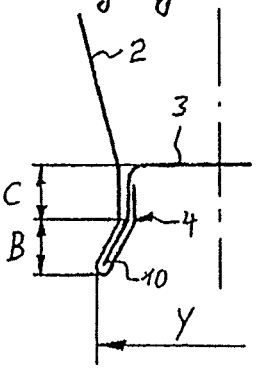
Figure 9K:
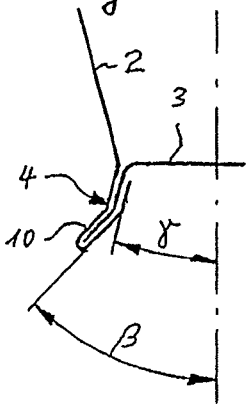

In the FIGS. 9H, 9J and 9K, embodiments of the bottom skirt 4 of the cup 1 are shown, in which the bottom skirt 4, in particular in the height area C, has varying angles of inclination to the middle axis 13. In the FIGS. 1 to 8 the angle of inclination $\gamma$ corresponds approximately to the angle of inclination $\alpha$ of the sleeve 2 in the area of the fillable interior 5. This embodiment is very simple to produce, as the semi-finished product possesses the same angle of inclination $\alpha$ over the entire height before the widening 10 is applied. Depending on the height Z of the bottom skirt 4, and the desired dimensions of the widening 10, it can however be necessary to use a semi-finished product in which the angle of inclination $\gamma$ of the bottom skirt 4 deviates from the angle of inclination $\alpha$, in order to prevent the paper material from tearing at the lower edge 14 when the bottom skirt 4 is widened. It can be sufficient to chose the angle of inclination $\gamma$, as shown in FIG. 9H, somewhat smaller than the angle of inclination $\alpha$. The angle of inclination $\gamma$ is advantageously so reduced that it measures approximately 0°, so that the bottom skirt 4 extends in the height area C approximately parallel to the middle axis 13, as shown in FIG. 9J. Greater dimensions Y of the widening 10 can be realized when widening by the same amount. This effect can be increased when the bottom skirt 4 already widens with an angle of inclination $\gamma$ in the height area C, as shown in FIG. 9K. In the case of the variation according to FIG. 9K the angle of inclination $\beta$ is advantageously larger than the angle of inclination $\gamma$.

The invention claimed is:

1. A process for producing a cup from a paper material comprising the steps of:

providing a cup including a conical sleeve member and a bottom member attached to the conical sleeve member in a liquid-tight manner with a bottom skirt such that the cup has an essentially liquid-tight fillable interior, the bottom member of the cup being attached to the conical sleeve member in an area of the conical sleeve member having a reduced diameter, and the bottom member having a bottom wall which defines part of the fillable interior of the cup;

thereafter widening: the conical sleeve member adjacent an area of the bottom skirt outwardly in at least one area located along a circumference of the conical sleeve member; or the bottom member adjacent an area of the bottom skirt outwardly in at least one area located along a circumference of the bottom member; or the bottom skirt outwardly in at least one area along a circumference of the bottom skirt, to form an outwardly projecting widening disposed below the bottom wall of the bottom member and having a lower terminal edge defining a supporting surface of the cup;

forming a holding structure on the conical sleeve member at a location spaced upwardly from the bottom wall, whereby the cup has respective dimensions defined at the holding structure and the lower terminal edge which are sized to permit support of the lower terminal edge of a first previously produced cup on the holding structure of a second previously produced cup when the first and second cups are vertically stacked;

said step of providing includes providing the cup with an imaginary line substantially parallel to the conical sleeve member and extending upwardly from the lower terminal edge of the widening and together with the conical sleeve member defining an outer space around the cup; and providing an outer sleeve within the outer space at a location above the widening.

2. The process of claim 1, wherein said step of providing the cup includes providing the cup with a longitudinal center axis, and said step of widening includes forming the widening so as to have a diameter, oriented transversely to the cup axis, which is greater than a diameter of the bottom wall oriented transversely to the cup axis.

3. The process of claim 2, wherein said step of providing the cup includes providing the bottom wall of the cup in an orientation transverse to the cup axis and so as to have an upper surface which defines a lower extent of the fillable interior of the cup.

4. The process of claim 1, wherein said step of providing the cup includes providing the bottom wall in a substantially horizontal orientation and so as to have an upper surface which defines a lower extent of the fillable interior of the cup and providing the conical sleeve member in a substantially upright orientation and so as to have an inner surface which defines an upper extent of the fillable interior.

5. The process of claim 1, wherein said step of widening includes forming the widening so as to flare outwardly and away from a longitudinal center axis of the cup as the widening projects in a direction away from the bottom wall.

6. The process of claim 5, wherein the dimension defined at the lower terminal edge is a diameter of the lower terminal edge, and said step of widening includes forming the widening so that the diameter of the lower terminal edge is a maximum diameter of the widening and is oriented transversely to the cup axis.

7. The process of claim 6, wherein said step of widening includes forming the widening so as to have a minimum diameter, oriented transversely to the cup axis, located above the lower terminal edge of the widening and spaced from the cup axis by a first distance, and so that the maximum diameter at the lower terminal edge of the widening is spaced from the cup axis by a second distance, the second distance being greater than the first distance.

8. The process of claim 7, wherein said step of providing the cup includes providing the bottom skirt with an overall height, oriented substantially parallel to the cup axis and extending between the bottom wall and the lower terminal edge of the widening, and said step of widening includes forming the widening so as to have an overall height, oriented substantially parallel to the cup axis, the overall height of the widening being less than the overall height of the bottom skirt.

9. The process of claim 1, wherein said step of providing the cup includes providing the cup with a longitudinal center axis and providing the bottom skirt so that the bottom skirt, when viewed in axial cross-section, has a portion which extends substantially parallel to the cup axis.

10. The process of claim 1, further including the step of warming up the paper material of the cup in an area of the bottom skirt at least one of: before; and during said step of widening.

11. The process of claim 1, further including the steps of sliding the outer sleeve onto the conical sleeve member and fixing the outer sleeve to the conical sleeve member.

12. The process of claim 1, wherein said step of forming the holding structure includes forming the holding structure on the conical sleeve member at a location spaced downwardly from an uppermost edge of the cup.

13. The process of claim 12, wherein said step of forming the holding structure includes forming a bead or rib in an area along a circumference of an inner surface of the conical sleeve member, which inner surface defines part of the fillable interior of the cup.

14. The process of claim 1, wherein said step of forming the holding structure includes forming the holding structure on the conical sleeve member at a location spaced downwardly from an uppermost edge of the cup, said process further including the steps of sliding the outer sleeve over the conical sleeve member and fixing the outer sleeve to the conical sleeve member, and said step of widening is carried out after said step of fixing.

15. The process of claim 1, wherein said step of providing the outer sleeve includes spacing the outer sleeve from the widening.

16. The process of claim 1, wherein said step of providing the cup includes providing the cup with a longitudinal center axis, and the respective dimensions of the cup defined at the holding structure and the lower terminal edge are respective diameters of the cup oriented transversely to the cup axis, and said step of providing the outer sleeve includes providing the outer sleeve within the outer space at a location entirely above, and so as not to be in contact with, a location of the widening where the widening initially projects outwardly.

17. A process for producing a cup from a paper material comprising the steps of:

providing a cup including a conical sleeve member and a bottom member attached to the conical sleeve member in a liquid-tight manner with a bottom skirt such that the cup has an essentially liquid-tight fillable interior, the bottom member of the cup being attached to the conical sleeve member in an area of the conical sleeve member having a reduced diameter, and the bottom member having a bottom surface which defines part of the fillable interior of the cup;

widening: the conical sleeve member adjacent an area of the bottom skirt outwardly in at least one area located along a circumference of the conical sleeve member; or the bottom member adjacent an area of the bottom skirt outwardly in at least one area located along a circumference of the bottom member; or the bottom skirt outwardly in at least one area along a circumference of the bottom skirt, to form an outwardly projecting widening disposed below the bottom surface of the bottom member and having a lower edge defining a supporting surface of the cup, the widening having a first dimension at a location along the cup where the widening first projects outwardly and a second dimension located between the location of the first dimension and the lower edge, the second dimension being greater than the first dimension;

forming a holding structure on the conical sleeve member at a location spaced upwardly from the bottom surface, whereby the lower edge of a first previously produced cup is supported on the holding structure of a second previously produced cup when the first and second cups are vertically stacked;

said step of providing includes providing the cup with an imaginary line substantially parallel to the conical sleeve member and extending upwardly from the lower edge of the widening and together with the conical sleeve member defining an outer space around the cup; and providing an outer sleeve within the outer space at a location entirely above the location of the first dimension of the widening so as not to be in contact with the widening at the location of the first dimension.

18. The process of claim 17, wherein said step of widening is carried out after said step of providing the cup.

19. The process of claim 17, wherein said step of providing the cup includes providing the cup with a longitudinal centerline, and said step of widening includes forming the widening so as to project radially outwardly in a direction away from the longitudinal centerline and so as to have a diameter, oriented transversely to the centerline of the cup, which is greater than a diameter of the bottom surface oriented transversely to the longitudinal centerline.

20. The process of claim 17, wherein said step of providing the cup includes providing the cup with a longitudinal center axis and the first and second dimensions are diameters of the widening oriented transversely to the cup axis, and the step of providing the outer sleeve includes providing the outer sleeve within the outer space so as not to be in contact with any part of the widening.

21. The process of claim 17, wherein said step of providing the cup includes providing the cup with a longitudinal center axis, and the widening at the location of the first dimension projects outwardly in a direction away from the cup axis.

22. A process for producing a cup from a paper material comprising:

attaching a conical sleeve member and a bottom member in a liquid-tight manner to one another with a bottom skirt to form a cup with a substantially liquid-tight fillable interior and so that a bottom surface of the bottom member defines part of the fillable interior of the cup;

widening the conical sleeve member or the bottom member adjacent an area of the bottom skirt or widening the bottom skirt itself, to form a widening which is disposed below the bottom surface, projects radially outwardly in a direction away from a longitudinal centerline of the cup and has a lower edge defining a supporting surface of the cup, the lower edge defining a bottom outer diameter of the cup oriented transversely to the longitudinal centerline of the cup, wherein an imaginary line extends upwardly from the lower edge of the widening substantially parallel to the conical sleeve member and together therewith defines an outer space around the cup;

forming a holding structure on the conical sleeve member at a location spaced upwardly from the bottom surface, the cup having an inner diameter, oriented transversely to the longitudinal centerline of the cup, at the location of the holding structure which is similar to or greater than the bottom outer diameter of the cup to allow support of the lower edge of a first previously produced cup on the holding structure of a second previously produced cup when the first and second cups are vertically stacked with the first cup inside the second cup; and providing an outer sleeve within the outer space above the widening.

23. The process of claim 22, wherein said step of widening includes forming the widening so as to have a diameter, oriented transversely to the longitudinal centerline of the cup, which is greater than a diameter of the bottom surface oriented transversely to the longitudinal centerline of the cup.

24. The process of claim 23, wherein said step of attaching includes attaching a side wall of the bottom member, the side wall depending downwardly from and being disposed in surrounding relationship with the bottom surface, and a lower part of the conical sleeve member in, overlapping relationship with one another and in a liquid-tight manner, wherein the overlapping lower part and the side wall together define the bottom skirt.

25. The process of claim 22, wherein said step of providing the outer sleeve includes providing the outer sleeve within the outer space at a location entirely above, and so as not to be in contact with, a location of the widening where the widening first projects outwardly away from the centerline of the cup.

* * * * *